US005401182A

United States Patent [19]

McHugh et al.

[11] Patent Number: 5,401,182

[45] Date of Patent: Mar. 28, 1995

[54] LOW PROFILE CONNECTOR AND CONTACT THEREIN

[75] Inventors: Robert G. McHugh, Evergreen, Colo.; Gwou-Jong Tseng; Jau-Wen Lin, both of Taipei Hsien,

[73] Assignee: Tongrand Limited, Hong Kong

[21] Appl. No.: 168,020

[22] Filed: Dec. 15, 1993

[51] Int. Cl.[6] ..... H01R 13/62

[52] U.S. Cl. ..... 439/326

[58] Field of Search ..... 439/59–62, 439/152–160, 326–329, 629–637

[56] References Cited

U.S. PATENT DOCUMENTS

| | | | |
|---|---|---|---|
| 4,718,859 | 1/1988 | Gardner | 438/326 X |
| 5,041,005 | 8/1991 | McHugh | 439/326 |
| 5,061,201 | 10/1991 | Tuan | 439/326 |
| 5,085,593 | 2/1992 | Tuan | 439/326 |
| 5,249,988 | 10/1993 | Lu | 439/326 X |

FOREIGN PATENT DOCUMENTS 2237151 4/1991 United Kingdom .

*Primary Examiner*—Khiem Nguyen

[57] ABSTRACT

A contact (10) comprising a planar conductor having an elongated base (12) with two opposite spaced ends (14, 16). A pair of contact beams (18, 20) respectively extend from a common position spaced from a first end (14) in a distance of generally one third of the whole length of the base (12). A high beam (18) of such pair of contact beams (18, 20) generally extends upward and slightly inclined to the first end. A generally U-shaped section (22) is positioned at the top of the high beam (18) wherein such U-shaped section (22) is dimensioned to be generally a half of the vertical dimension of the whole high beam (18). A low beam (20) of such pair of contact beams (18, 20) generally extends horizontally to the second end (16) of the base (12). A generally C-shaped section (24) is backward positioned at the free end of the low beam (20) wherein such C-shaped section (24) is dimensioned to be generally a half of the horizontal dimension of the whole low beam (20). The tip (26) of the high beam (18) and the tip (28) of the low beam (20) are generally positioned at the same height of the contact (10). A high support (30) and a low support (32) respectively extend vertically from the first and the second ends (14, 16) of the base (12) of which barbs (34, 36) protrude outwardly for retaining the contact (10) within the connector (50). One mounting section (38) extends downward from the base (12) for mounting the contact (10) on a board on which the connector (50) is seated.

12 Claims, 6 Drawing Sheets

LOW PROFILE CONNECTOR AND CONTACT THEREIN

BACKGROUND OF THE INVENTION

1. Field of The Invention

The invention relates to a low profile contact for use within a low profile slanted type connector which is mounted on a mother board and ready to receive a daughter board therein, especially to a 40 degrees SIMM socket connector.

2. The Prior Art

Single In-Line Memory Module (SIMM) is popularly used in the computer industry now. Various shapes of the contacts are developed for use with SIMM socket connector or other card edge type connectors, for example, U.S. Pat. Nos. 3,732,531, 4,557,548, 4,575,172, 4,713,013, 4,718,859, 4,722,700, 4,737,120, 4,756,694, 4,781,612, 4,911,653, 4,957,448, 4,960,386, 4,973,270, 4,984,996, 4,998,890, 5,009,611, 5,013,257, 5,013,264, 5,015,196, 5,021,200, 5,049,511, 5,061,200, 5,064,381, 5,071,371, 5,076,804, 5,080,602, 5,082,459, 5,085,593, 5,100,337, 5,100,338, 5,112,231, 5,147,214, 5,151,046, 5,199,895, 5,207,598, 5,254,017, 5,259,793 and 5,259,795.

It can be understood that most recent contact designs attempt to achieve a sufficiently strong retention normal force with the module which is inserted into the socket connector for good mechanical and electrical mating therewith, and also to obtain a sufficiently resilient character thereof to be adopted to comply with most modules which may be of different thicknesses. The common method used by such contact designs to achieve such goals is to prolong the length of the contact beam as long as possible by the way of having such contact beam be a configuration of a series of curves. Undoubtedly, this method works in the contact design of the conventional SIMM socket. While in the recent years, the height and the size of the computer are miniaturized for use with a portable style, and most components used in such computer are also required to reduce their scales in compliance with the trend of miniaturization. The SIMM socket is also seeking a small size thereof without exception nowadays. In other words, the height and the width of the SIMM socket are of the reduced dimensions. Correspondingly, the size of the contact used in such miniaturized socket is also required to be smaller than that in the conventional socket. Under this situation, only the less space or dimension is available for the contact beam to curvilinearly extend therein for obtaining its expected resilience and retention force with the inserted module. One limitation has been experienced in manufacturing that the width of such curved contact beam should not smaller than the thickness thereof in design, (the relationship between the width and the thickness of the contact beam can be referred to U.S. Pat. Nos. 4,998,890, 5,061,200 and 5,199,895); otherwise, such contact beam may twist itself during stamping precess in manufacturing. Other disadvantage is also found that the curvilinearly extending contact beam is not expected to be curved so densely because it will make manufacturing complicated to increase the cost, and the small radius curve will result in stress concentration which may jeopardize duration of the contact beam after repeated use.

Based on the aforementioned limitations and requirements, the invention is to provide a specific type contact which is adapted to be used in a low profile 40° SIMM socket for miniaturization consideration in a smaller sized computer. The configuration of the contact in the invention has been evaluated through FEA (Finite Element Analysis) process and proven to meet the requirements of providing the sufficient normal force thereof for retain the module therein, and of compliance with modules of different thicknesses.

SUMMARY OF THE INVENTION

According to one aspect of the invention, a contact comprising a planar conductor having an elongated base with two opposite spaced ends. A pair of contact beams respectively extend from a common position spaced from a first end in a distance of generally one third of the whole length of the base. A high beam of such pair of contact beams generally extends upward and slightly inclined to the first end. A generally U-shaped section is positioned at the top of the high beam wherein such U-shaped section is dimensioned to be generally a half of the vertical dimension of the whole high beam. A low beam of such pair of contact beams generally extends horizontally to the second end of the base. A generally C-shaped section is backward positioned at the free end of the low beam wherein such C-shaped section is dimensioned to be generally a half of the horizontal dimension of the whole low beam. The tip of the high beam and the tip of the low beam are generally positioned at the same height of the contact. A high support and a low support respectively extend vertically from the first and the second ends of the base of which barbs protrude outwardly for retaining the contact within the connector. One mounting section extends downward from the base for mounting the contact on a board.

DETAILED DESCRIPTION OF THE PREFERRED EMBODIMENTS

References will now be made in detail to the preferred embodiments of the invention. While the present invention has been described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
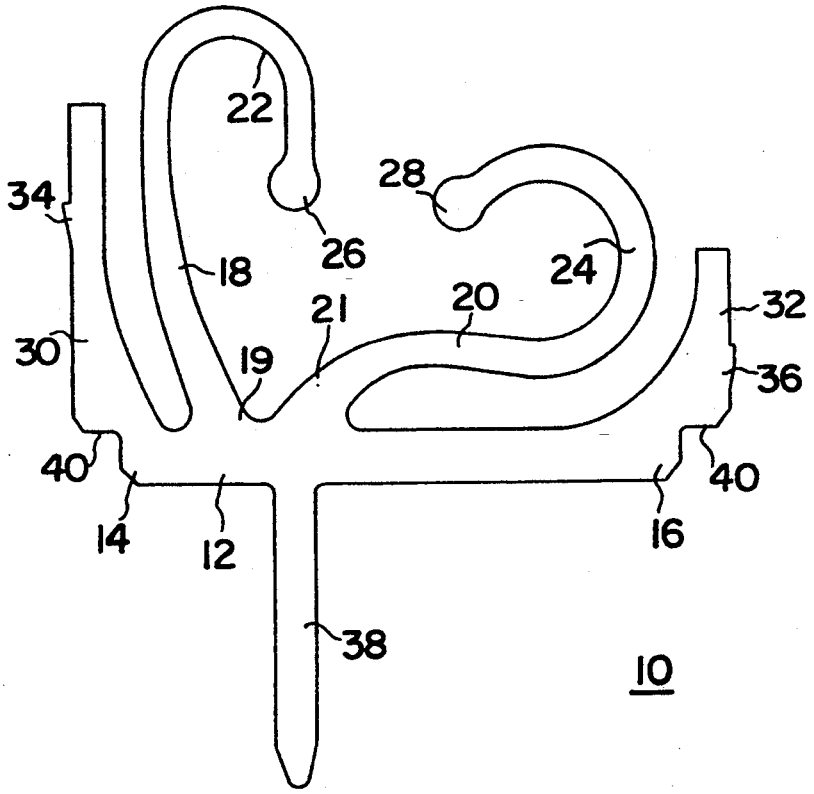
FIG. 1 is an enlarged elevation of a contact of the presently preferred embodiment according to the present invention.

It will be noted here that for a better understanding, like components are designated by like reference numerals throughout the various figures in each embodiment. Attention is now directed to FIG. 1 wherein the planar contact which directly stamped from a metal blank is designated by numeral 10 including an elongated base 12 with two opposite spaced first end 14 and second end 16.

A pair of contact beams extending upward from a position spaced from the first end 14 in a distance of generally one third of the whole length of the base 12, includes a high beam 18 and a low beam 20. The high beam 18 generally extends upward and slightly inclined to the first end 14. A generally U-shaped section 22 is positioned upside-down at the top of the high beam 18. The U-shaped section 22 is dimensioned to be generally a half of the vertical dimension of the whole high beam 18 wherein the height of the high beam 18 is generally two thirds of the whole length of the base 12. It is seen that the high beam 18 around its junction portion 19 with the base 14 initially extends upwardly at an angle of generally 60 degrees, and successively extends in a vertical direction and parallel to a high support 30 which is spaced beside the high beam 18 and will be illustrated later in detail.

Opposite to the high beam 18, the low beam 20 extends, to the second end 16 of the base 12, generally horizontally and parallel to the base 12. A generally C-shaped section 24 is backward disposed at the free end of the low beam 20. The C-shaped section 24 is dimensioned to be a half of the horizontal dimension of the whole low beam 20 wherein the height of the low beam is generally two fifths of the whole length of the base 12. It is noted that the low beam 20 around its junction portion 21 with the base 12 initially extends upward at an angle of generally 45 degrees, and successively extends in generally a horizontal direction to the low support 32 which is spaced beside the low beam 20 and will be illustrated in detail later.

It is seen that the tip 26 of the high beam 18 is generally aligned above the junction portions (19, 21) of such pair of contact beams 18 and 20 with the base 12 in the vertical direction. The tip 28 of the low beam 20 is generally positioned at the same height with the tip 26 of the high beam 18. The horizontal dimension of the high beam 18 is generally one fifth of the whole length of the base 12, the horizontal dimension of the low beam 20 is generally one half of the whole length of the base 12, and the space between the tip 26 of the high beam 18 and the tip 28 of the low beam 20 is generally one fourth of the whole length of the base 12.

Spaced from the high beam 18, the high support 30 vertically extends upward from the first end 14 of the base 12 and terminates at a position somewhat lower than the top point of the high beam 18, and a barb 34 protrudes outwardly thereof for engagement within the socket connector. Similarly, a low support 32 vertically extends upward from the second end 16 of the base 12 and terminates at a position somewhat lower than the top point of the low beam 20, and a barb 36 protrudes outwardly thereof for engagement within the socket connector. A mounting leg 38 extends downward from the base 12 for solderably mounting on a board on which is the socket connector is seated.

A pair of recesses 40 are respectively positioned at two outermost ends of the base 12, and generally aligned below the high support 30 and the low support 32, respectively. The height of each recess is generally equal to that of the base 12 for engagement with the engagement bar in the socket connector which will be illustrated next.

Figure 2:
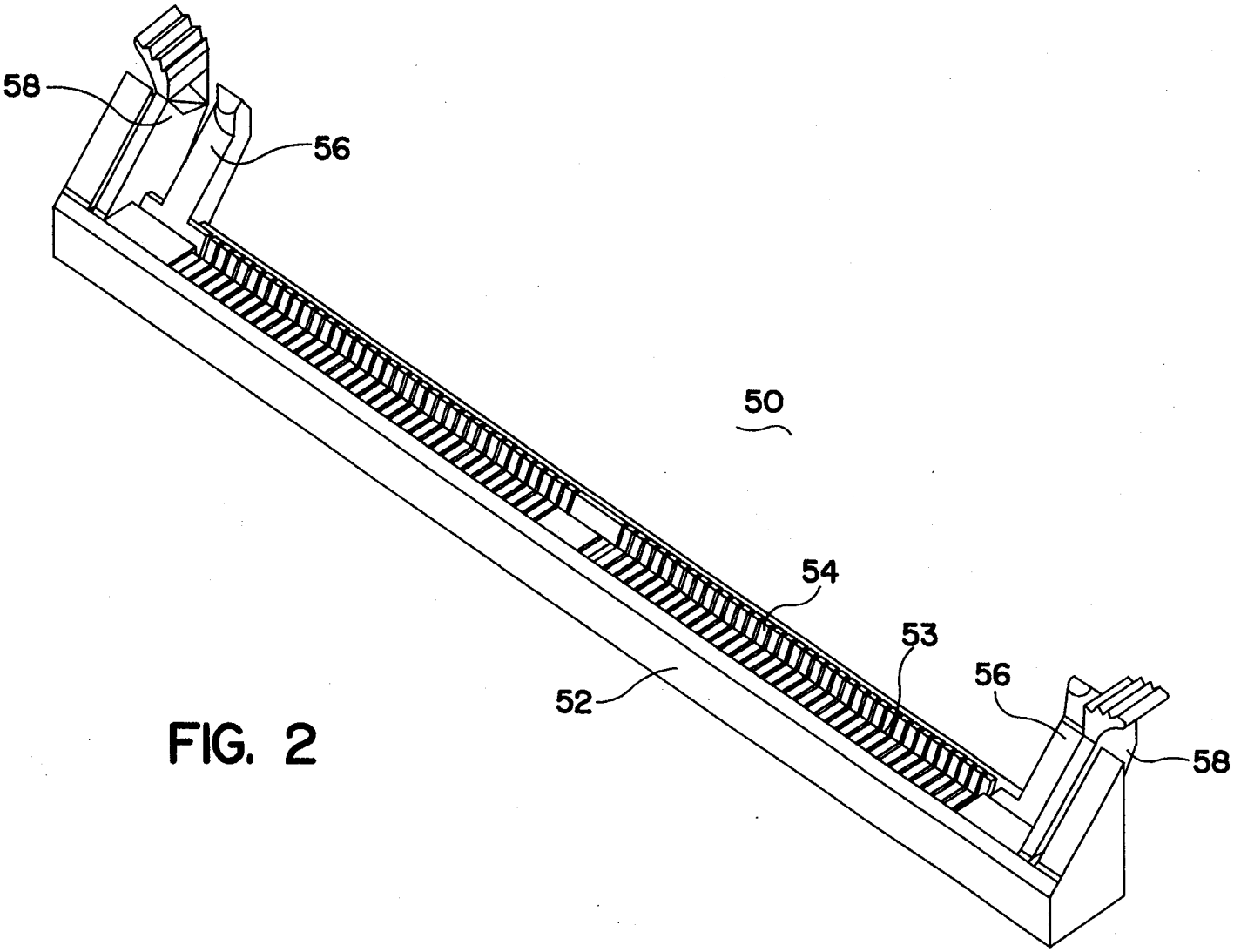
FIG. 2 is a perspective view of a 40° SIMM socket connector used in the present invention.

As shown in FIG. 2, the SIMM socket connector 50 includes an elongated insulative housing 52 having a slot 53 therein for receiving a module therein, and a plurality of side-by-side cavities 54 extending vertically through the housing 52 for receiving the corresponding contacts 10 therein. A pair of retention peg posts 56 and a pair of latches 58 are positioned approximate two opposite ends of the housing 52 for retaining the inserted module (not shown) in place.

Figure 3:
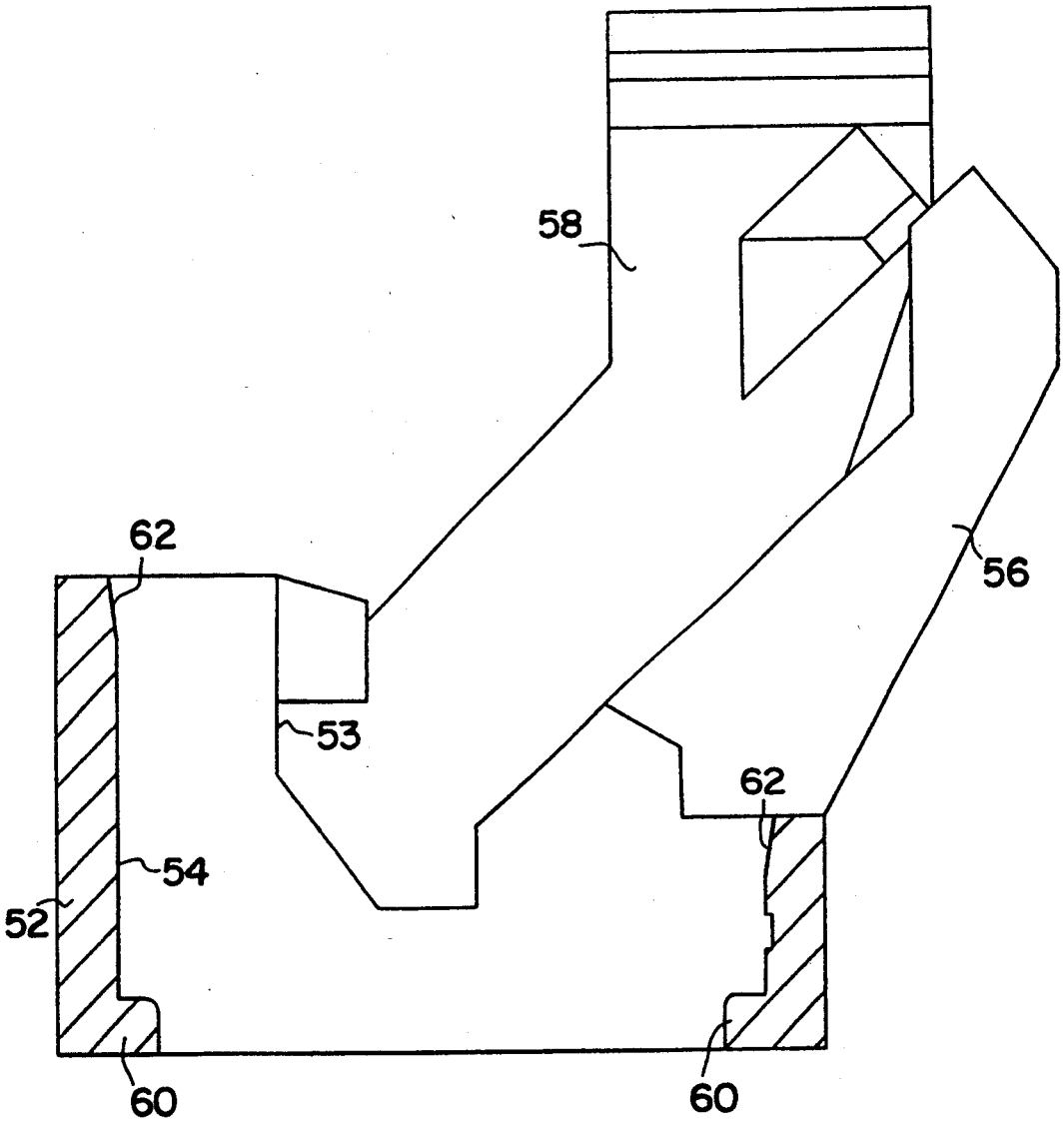
FIG. 3 is a cross-sectional view of the connector of FIG. 2 without the contact and the module therein.

Referring to FIG. 3, a pair of engagement bars 60 integrally extending from the housing 52 are, opposite with each other, positioned at the bottom of the corresponding cavity 54. A pair of chamfers 62 are, opposite with each other, positioned at the top of the corresponding cavity 54.

Figure 4:
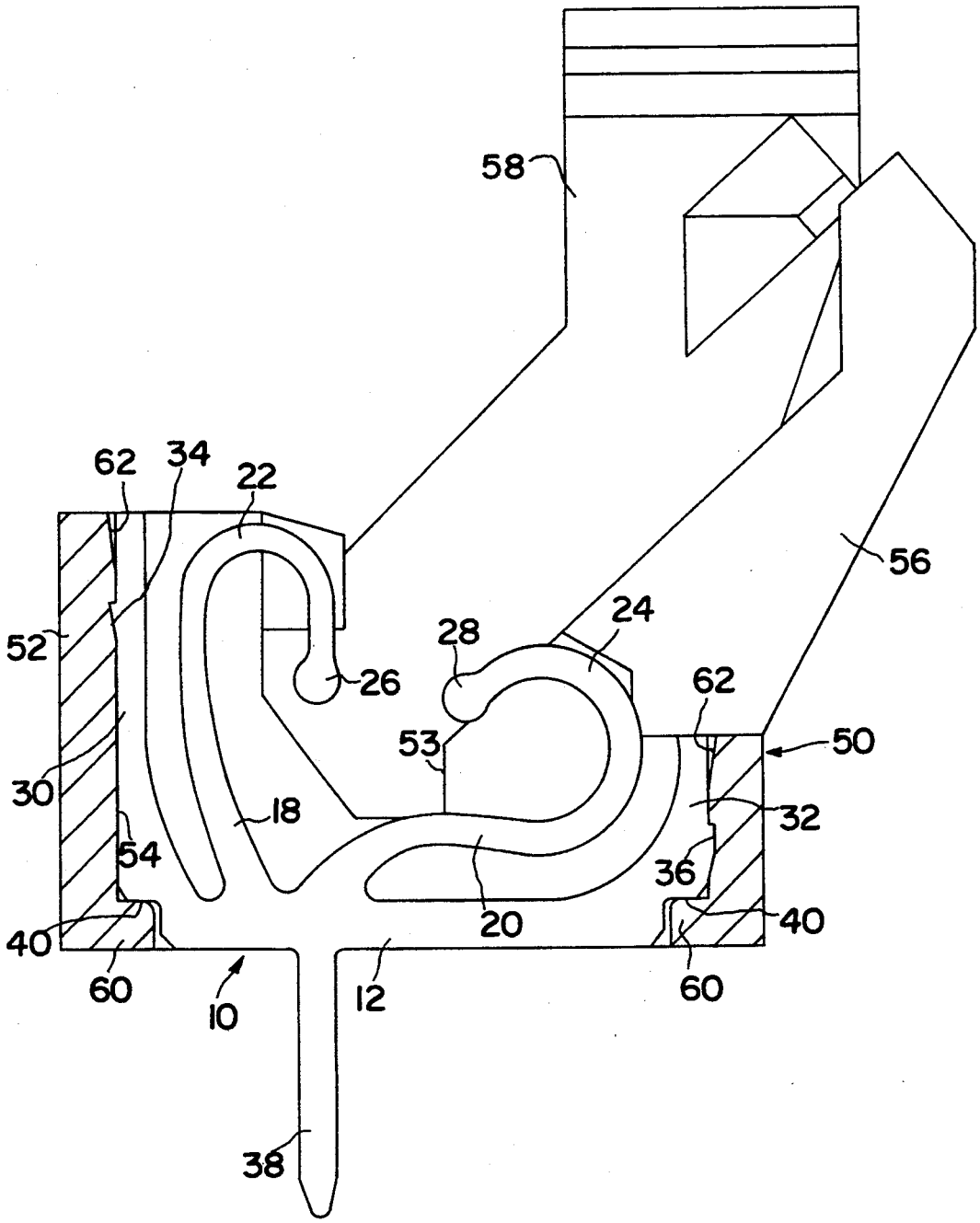
FIG. 4 is a cross-sectional view of the connector of FIG. 2 with the contact of FIG. 1 but without the module therein.

As shown in FIG. 4, during assembling, the contact 10 is loaded into the cavity 54 in the socket connector 50. The barbs 34, 36 of the high support 30 and the low support 32 can be inserted into the cavity 54 along the chamfers 62 of the housing 52, and the contact 10 continuously moves downward until the engagement bars 60 in the cavity 54 abut against the corresponding recesses 40 of the contact 10. Therefore, the contact 10 can be stably retained within the cavity 54 of the housing 52 without vertical or horizontally movements wherein the downward movement is restrained by engagement with the engagement bars 60, the upward movement is restrained by the barbs 34, 36, and the horizontal movement including the lateral movement and the movement in the lengthwise direction along the housing 52 are confined by the configuration of the cavity 54.

Figure 5:
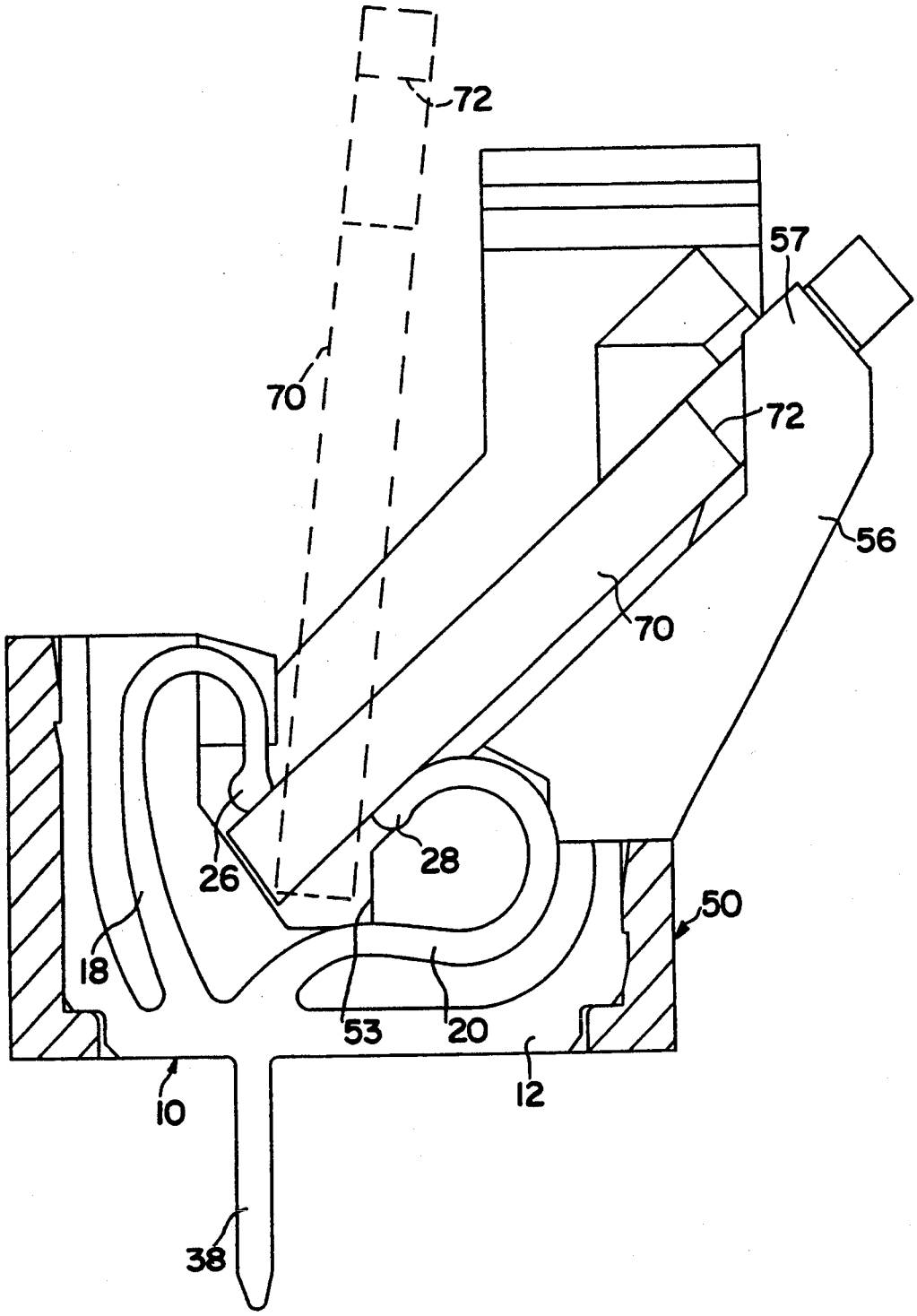
FIG. 5 is a cross-sectional view of the connector of FIG. 2 with the contact of FIG. 1 and the module therein.

Referring to FIG. 5, a module 70 is inserted into the slot 53 of the socket connector 50 at an angle without touching the contact beams 18 and 20 for zero insertion force (ZIF). Then, the module 70 is rotated to abut onto the retention peg post 56. At the same time, the side hole 72 of the module 70 captivates the peg 57 on the peg post 56, and the latch 58 prevents the backward movement of the module 70 with regard to the socket connector 50. Under this situation, the opposite surfaces of the lower portion of the module 70 can respectively engage the tips 26, 28 of the high beam 18 and the low beam 20 for mechanical and electrical connection. It should be appreciated that the contact 10 shown in FIG. 5 keeps its original shape for not complicating the figure, but in fact such contact 10 should be substantially deflected to comply with the final position of the module (70).

It can be contemplated that the aforementioned definition of "40°" results from the module 70 lying slantingly with regard to the mounting board at an angle of 40 degrees. This configuration is popularly requested by the most recent miniaturized computers. The aforementioned specifically shaped contact 10 is designated to meet the requirements of such 40 degrees SIMM socket configuration. Some aforementioned prior art contacts disclosed in U.S. Pat. Nos. 4,557,548, 4,722,700, 4,737,120, 4,984,996, 5,013,257, 5,015,196, 5,049,511, 5,051,046, 5,064,381, 5,080,602, 5,100,338 and 5,147,214, each of which has a solid portion at the bottom of each corresponding cavity in the housing of the connector where the contact is seated, are so-called top-loading type. Such top-loading type contact and its corresponding socket connector generally has a larger height of its housing thereof due to the existence of such solid portion on which such contact is seated. Thus, this type configuration can not easily meet the requirement of reduced height of a miniaturized computer.

In contrast, other aforementioned prior art contacts disclosed in U.S. Pat. Nos. 3,732,531, 4,575,172, 4,713,013, 4,718,859, 4,957,448, 4,960,386, 4,973,270, 5,009,611, 5,013,264, 5,061,200, 5,076,804, 5,082,459, 5,100,337 and 5,254,017, each of which has an through opening at each cavity in the housing for insertion of the contact into the cavity, are so-called bottom-loading type. Even though such bottom-loading type contact and its corresponding housing of the socket connector can lower the whole height of the housing of the connector because the cavity which receive the contact therein can directly communicate with the board on which the connector is seated, without a space defined by such aforementioned solid portion of the housing, the bottom-loading feature may sometimes induce questionable reliability or stability of such engagement. So sometimes, the wall along the housing of the socket connector of this type needs to further have the indents in alignment with and in communication with the corresponding cavities to receive the corresponding protrusion of the contacts for preventing downward movement of the inserted contact, as shown in U.S. Pat. Nos. 4,957,448, 4,960,386, 4,998,890 and 5,085,593. This attempt sometimes reduce the stiffness of the original housing, and results in a deformation of such molded housing.

Different from the prior art contacts, the contact 10 used in the connector housing 52 in the present invention, not only belongs to the top-loading type which owns the reliable and stable retention feature than the bottom-loading type, but also lacks the solid portion at the bottom of the corresponding cavity 54 in the housing 52. Because of lacking such bottom solid portion below the cavity 54, the base 12 of the contact 10 can directly seated on the board on which the connector 50 is mounted, so that it can correspondingly reduce the associated height of the housing 52 of the connector 50 in comparison with the prior art top-loading type connector under the condition that such contact 10 has the same height as that of the original one. The reason why the present invention can adopt this style combination between the contact 10 and the housing 52, is that the contact 10 has such pair of recesses 40 at two ends of the base 12 to fully engage the corresponding engagement bars 60 positioned at approximate the bottom of the cavity 54 of the housing 52 wherein the height of the recess 40 is generally equal to the height of the base 12 so that the bottom edge of the base 12 can be seated against the board on which the connector 50 is mounted. Furthermore, such recesses 40 are designedly positioned respectively below and in alignment with the high support 30 and low support 32 in a vertical direction, so that such configuration will not influence the orientation or the positions of those supports 30, 32. In other words, such supports 30 and 32 do not need to change their positions for providing additional space for compliance with the provided engagement bars 60, so that the width, i.e., the dimension along the base 12, of the contact 10 still can be kept as small as possible in compliance with the requirements of the miniaturized computer.

It can be understood that the specific shape in the invention is specially intended to be adapted to be used with the 40° SIMM socket, so that the configurations, including the positions and the extending directions, of the beams 18 and 20 are critical for implementation of efficiently mating with the module pads. This is because only the limited space including the vertical dimension and the horizontal dimension are available in such contact design. It is also noted that the simplicity of the configuration of the contact beam 18, 20 is beneficial for manufacturing in such stamped contact, and also allows larger radius around the curved portion thereof not to result in stress concentration thereof for lasting the lifetime of the contact during repeated use.

In conclusion, the contact 10 as shown in FIG. 1 for use with the low profile 40° SIMM socket connector 50 not only provides the sufficient retentive normal force for mechanically and electrically engaging the module 70 therein, but also allows variation of thickness of such module 70 in a range due to its specific configuration.

Figure 6:
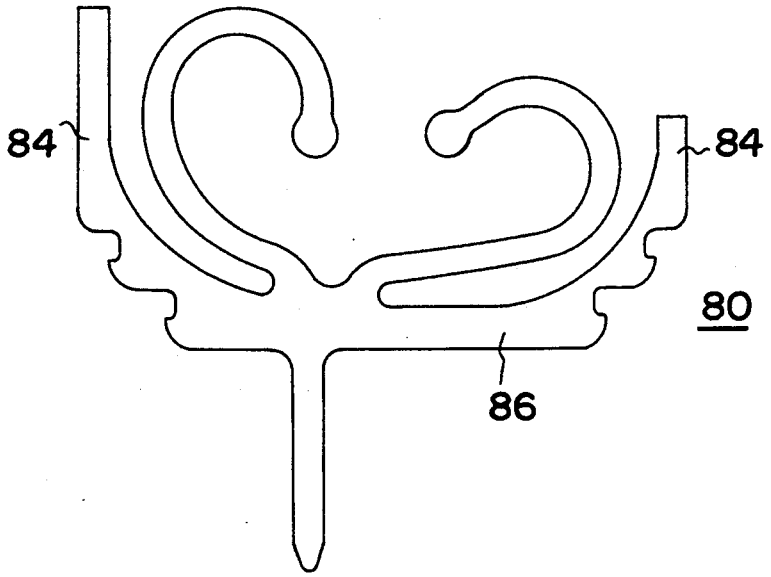
FIG. 6 is an enlarged elevation of a contact of the second embodiment.
Figure 7:
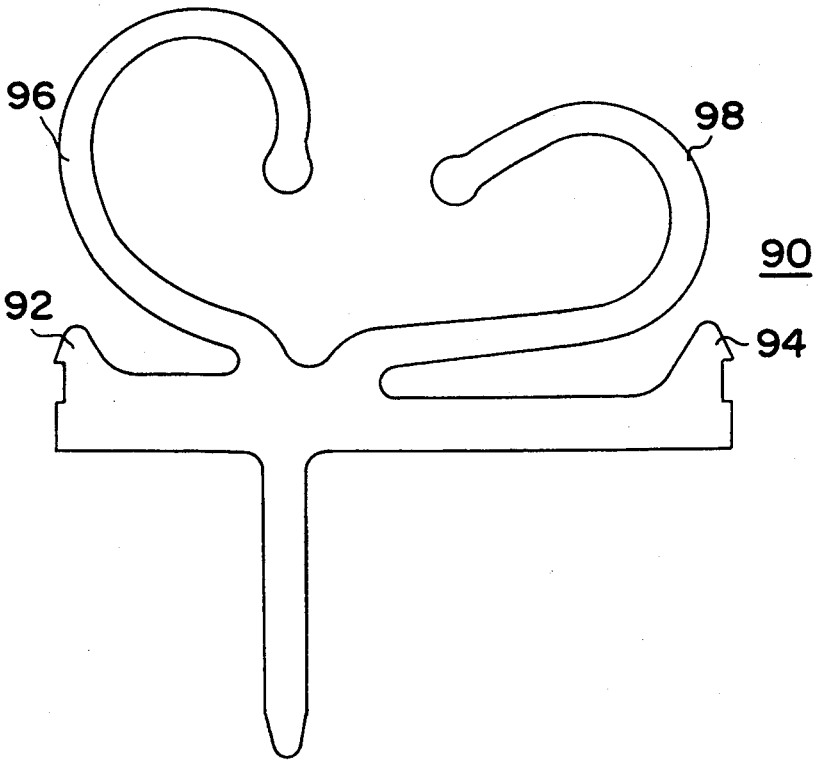
FIG. 7 is an enlarged elevation of a contact of the third embodiment.

FIG. 6 shows another embodiment of the contact 80 which has generally the similar shape as the contact 10 of the first embodiment. The difference is that the retention barbs 82 are positioned at the corners of the junctions of the side support 84 and the base 86. FIG. 7 shows the third embodiment of the contact 90 which also has generally the similar shape as the contact 10 of the first embodiment. The difference is that the side high and low supports 92, 94 are shortened and moved to be positioned below the contact beams 96, 98 so that the contact 90 may be loaded into the socket housing from the bottom.

While the present invention has been described with reference to a few specific embodiments, the description is illustrative of the invention and is not to be construed as limiting the invention. Various modifications to the present invention can be made to the preferred embodiment by those skilled in the art without departing from the true spirit and scope of the invention as defined by the appended claims.

Therefore, persons of ordinary skill in this field are to understand that all such equivalent structures are to be included within the scope of the following claims.

What is claimed is:

1. A contact for use with a low profile slanted connector comprising:

an elongated base with two opposite spaced first and second ends;

a pair of contact beams respectively extending from a common position of said base;

a high beam of said contact beams generally extending upward and slightly inclined to the first end of the base;

a generally U-shaped section upside-down positioned at a top portion of the high beam;

a low beam of said contact beams generally extending horizontally to the second end of the base;

a generally C-shaped section backward positioned at a free end of the low beam;

a high support and a low support respectively extending vertically from the first and the second ends of the base; and a mounting section positioned on a bottom portion of the base;

wherein said common position from which said pair of contact beams extend is spaced from the first end by a distance of generally one third of a whole length of the base, and the high support and the low support are respectively positioned beside the corresponding high beam and the low beam, and wherein a horizontal dimension of the high beam is generally one fifth of the whole length of the base, a horizontal dimension of the low beam is generally one half of the whole length of the base, a vertical dimension of the high beam is generally two thirds of the whole length of the base, and a vertical dimension of the low beam is generally two fifths of the whole length of the base.

2. The contact as described in claim 1, wherein said U-shaped section is dimensioned to be a half of a vertical dimension of the whole high beam.

3. The contact as described in claim 1, wherein said C-shaped section is dimensioned to be a half of a horizontal dimension of the whole low beam.

4. The contact as described in claim 1, wherein a tip of the high beam and a tip of the low beam are generally positioned at a same height of the contact, and have a distance therebetween of generally one fourth of the whole length of the base, said tip of the high beam being generally positioned and aligned above said common position of the base in a vertical direction.

5. The contact as described in claim 1, wherein the high beam around a junction portion with the base initially extends upward at an angle of generally 60 degrees, and successively extends in a vertical direction and parallel to the high support.

6. The contact as described in claim 1, wherein the low beam around a junction portion with the base extends upward at an angle of generally 45 degrees, and successively extends in generally a horizontal direction to the low support.

7. The contact as described in claim 1, wherein barbs project outwardly from the high support and the low support, respectively.

8. The contact as described in claim 1, wherein a pair of recesses are positioned at the first and the second ends of the base, respectively, said recess positioned and generally aligned below the corresponding support in a vertical direction, a height of said recess being generally equal to that of the base.

9. The contact as described in claim 1, wherein said mounting section is a leg extending downward from the base.

10. The contact as described in claim 1, wherein barbs are positioned around corners of junctions of the supports with the base.

11. A 40° SIMM socket connector (50) comprising:

an elongated insulative housing (52) having a slot (53) therein for receiving a module (70) therein;

a plurality of side-by-side cavities (54) extending vertically through the housing (52) for receiving corresponding contacts (10) therein;

a pair of retention peg posts (56) positioned proximate two opposite ends of the slot (53);

a pair of latches (58) positioned proximate two opposite ends of the housing (52);

a pair of engagement bars (60) positioned at a bottom portion of each cavity (54);

each contact (10) being stamped from a metal blank and comprising:

an elongated base (12) with two opposite spaced first end (14) and second end (16);

a pair of contact beams (18, 20) respectively extending from a common position of said base (12);

a high beam (18) of said contact beams (18, 20) generally extending upward and slightly inclined to the first end (14) of the base (12);

a generally U-shaped section (22) upside-down positioned atop the high beam (18);

a low beam (20) of said contact beams (18, 20) generally extending horizontally to the second end (16) of the base (12);

a generally C-shaped section (24) backward positioned at a free end of the low beam (20);

a high support (30) and a low support (32) respectively extending vertically from the first end (14) and the second end (16) of the base (12);

a mounting leg (38) extending from the base (12); and a pair of recesses (40) respectively positioned at the first end (14) and the second end (16) of the base (12) for engagement with said engagement bars (60) in each cavity (54) wherein said base (12) is generally positioned between said pair of engagement bars (60), and the hugh support (30) and the low support (32) are generally positioned above the corresponding engagement bars (60), respectively, so that said contact (10) can be loaded into the corresponding cavity (54) in the housing (52) from the top, and the base (12) can be directly seated on a board on which the connector (50) is mounted.

12. A contact for use with a low profile slanted connector comprising:

an elongated base with two opposite spaced first and second ends;

a pair of contact beams respectively extending from a common position of said base;

a first beam of said contact beams generally extending upward and slightly inclined to the first end of the base;

a generally U-shaped section upside-down positioned atop the first beam;

a second beam of said contact beams generally extending laterally to the second end of the base;

a generally C-shaped section backward positioned at a free end of the second beam;

a first support and a second support respectively extending upwardly from the first and the second ends of the base; and a mounting section extending from the base;

wherein the first support and the second support are respectively positioned beside the corresponding first beam and the second beam, said common position from which said pair of contact beams extend is generally in a middle portion of the base and is substantially spaced from the first and the second ends, respectively, and said common position is substantially closer to the first support than to the second support.

* * * * *